United States Patent [19]

Dawson

[11] Patent Number: 4,830,594

[45] Date of Patent: May 16, 1989

[54] EPOXY APPLICATOR FOR CORNERS

[76] Inventor: Brian A. Dawson, P.O. Box 596, Waterford, Conn. 06385

[21] Appl. No.: 49,181

[22] Filed: May 13, 1987

[51] Int. Cl.[4] ..... B28B 3/00

[52] U.S. Cl. ..... 425/87; 425/375; 401/5; 401/9; 401/48; 401/193; 404/110; 118/108; 118/305; 118/413; 15/105.5; 15/235.7

[58] Field of Search ..... 425/64, 466, 375, 87; 156/578, 575; 404/98, 110; 401/48, 5, 9, 193; 118/108, 410, 413, 305; 15/235.4, 105.5, 235.7

[56] References Cited

U.S. PATENT DOCUMENTS

| | | | |
|---|---|---|---|
| 2,594,606 | 4/1952 | Ames | 425/87 |
| 2,824,443 | 2/1958 | Ames | 401/9 X |
| 2,889,965 | 6/1959 | Ames | 401/9 X |
| 3,087,654 | 4/1963 | Moore | 401/9 |
| 3,108,518 | 10/1963 | O'Connor, Jr. | 425/64 X |
| 3,241,174 | 3/1966 | Callahan | 401/9 |
| 4,027,990 | 6/1977 | Merrill | 404/98 |
| 4,055,384 | 10/1977 | Palzer | 156/578 X |
| 4,287,141 | 9/1981 | Russell | 425/64 X |

FOREIGN PATENT DOCUMENTS

| | | | |
|---|---|---|---|
| 632825 | of 1963 | Belgium | 401/193 |

*Primary Examiner*—Richard J. Apley
*Assistant Examiner*—David J. Bender
*Attorney, Agent, or Firm*—Sughrue, Mion, Zinn, Macpeak & Seas

[57] ABSTRACT

An epoxy applicator having a housing for receiving epoxy material to be spread against a floor wall interface, said housing having a bottom open end and a partially open back end; supports on the housing for supporting the housing on the floor and against the wall; and handles on the housing such that the housing may be moved along the floor and against the wall such that epoxy material is applied to the floor and the wall through the open bottom end and the partially open back end forming an L-shaped layer of epoxy material on the floor and against the wall.

6 Claims, 2 Drawing Sheets

EPOXY APPLICATOR FOR CORNERS

BACKGROUND OF THE INVENTION

1. Field of the Invention

This invention pertains to a device for uniformly spreading an epoxy mixture of cementitious consistency on perimeter walls and partitions and floor areas adjacent said walls and partitions.

2. Statement of the Prior Art

The prior art shows applicators for applying plaster and mastic materials to surfaces and also shows wheeled mortar spreaders for applying a layer of mortar material to the top course of a wall being built. None of these prior art devices discloses an apparatus for simultaneously applying an epoxy mixture of cementitious consistency to the perimeter walls and partitions and floor areas adjacent said perimeter walls and partitions.

Representative of the prior art devices are the following list of patents.

| Inventor | U.S. Pat. No. | Title |
|---|---|---|
| C. D. Doll | 1,158,460 | Mortar Spreader |
| J. W. Kavanagh | 1,833,582 | Bricklaying Machine |
| H. J. Ciceske | 2,341,691 | Mortar Spreader |
| R. K. Fraser | 2,376,243 | Viscous Liquids |
| P. H. Sommers | 2,630,703 | Plaster Applicator |
| R. G. Ames | 2,984,857 | Mastic Applicator |

SUMMARY OF THE INVENTION

There is a need for an inexpensive yet efficient apparatus for simultaneously and uniformly applying an epoxy mixture of cementitious consistency to the perimeter walls and floor areas of a room.

It is one principal object of this invention to provide such an applicator having an open back portion and an open bottom for the flow of an epoxy mixture of cementitious consistency.

Another object of this invention is to provide such an applicator having adjustable skids whereby the applicator may be vertically adjusted to a desired elevation.

An yet another object of the invention is to provide such an applicator, which is advanced along a wall and floor areas, having trowel wings for supporting hand held trowels whereby the epoxy mixture is compressed against the wall and floor areas as the applicator is advanced.

These and other objects of the invention will become apparent to those skilled in the art to which the invention pertains from a reading of the following specification when taken in light of the annexed drawings.

DETAILED DESCRIPTION OF THE PREFERRED EMBODIMENT OF THE INVENTION

Figure 1:
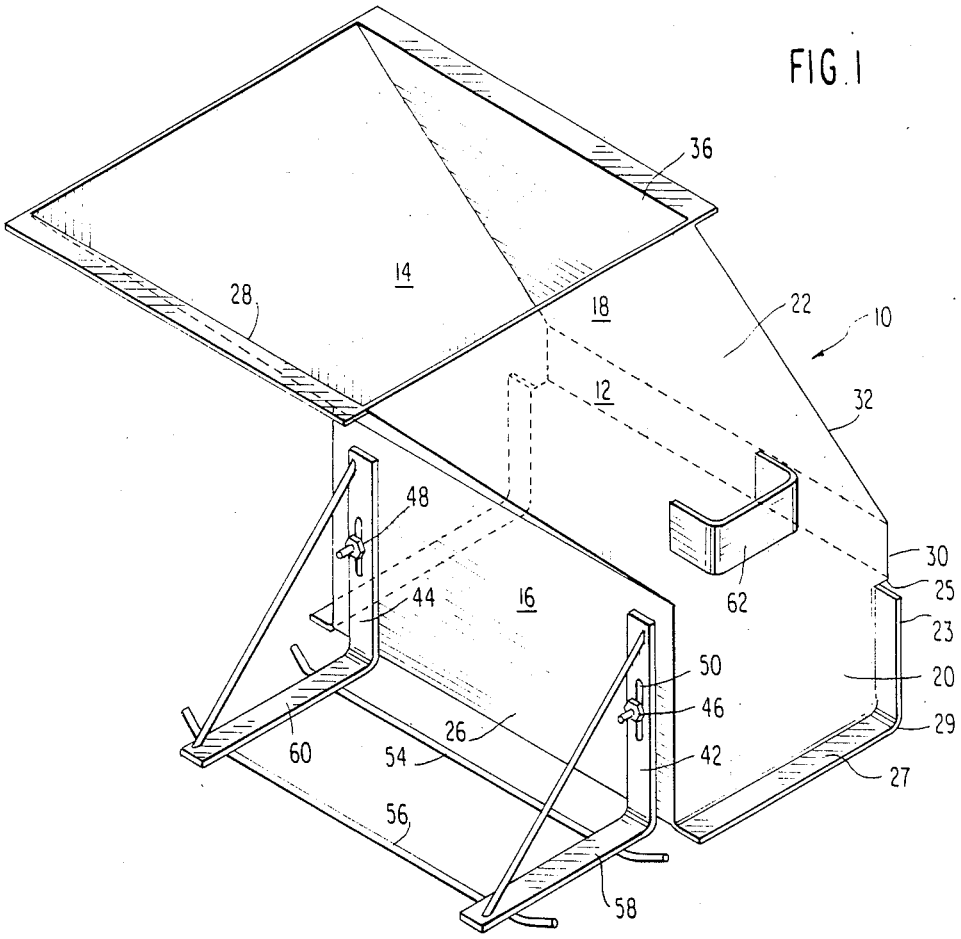
FIG. 1 is a perspective view of the epoxy applicator showing adjustable skids thereon.
Figure 2:
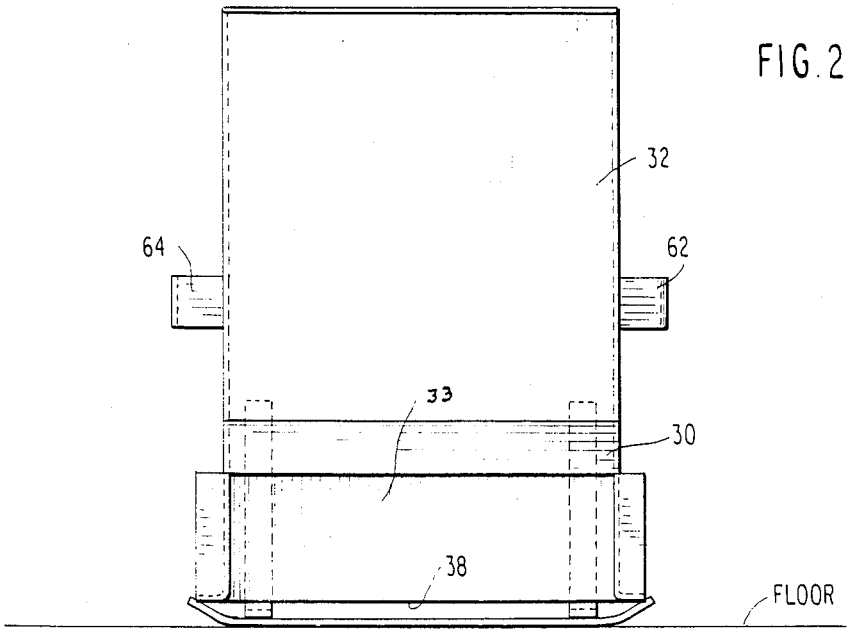
FIG. 2 is a rear view of the epoxy applicator showing trowel wings adjacent the open back portion.
Figure 3:
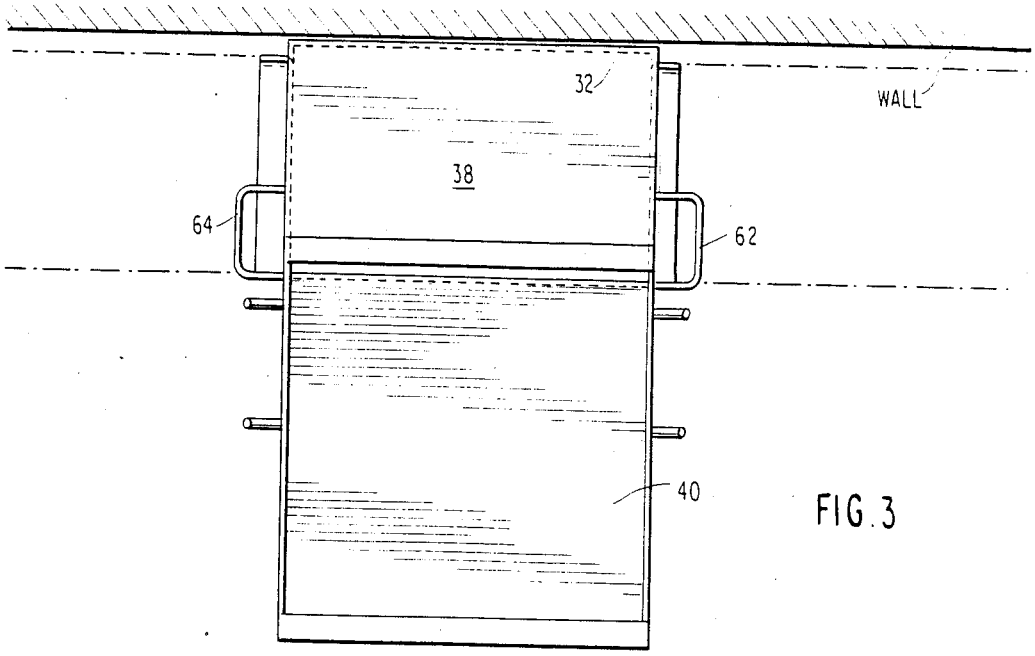
FIG. 3 is a plan view of the applicator in position on a floor and against a wall where the epoxy mixture is to be applied.

Referring to the drawings in more detail, FIG. 1 shows the applicator 10 comprising a housing having sidewalls 12 and 14, front wall 16 and back wall 18. Each of the sidewalls 12, 14 has a lower vertical section 20 and an upwardly and forwardly extending upper section 22. The lower section 20 has a wing 23 formed by making a one-quarter inch cut along the line 25 and bending the trowel wing 23 outwardly. Bottom portion 20 has an outwardly extending trowel wing section 27 which is coterminus with trowel wing section 23 to form a rounded end 29. The front wall 16 has a lower section 26 and an upper section 28 extending upwardly and forwardly from section 26. The back wall 18 has a vertical section 30 and an upper section or hopper 32 which extends upwardly and forwardly from section 30. The vertical section 30 is cut away to leave an opening 33 (FIG. 2) the width of the applicator being two and one-half inches high. Thus constructed, the applicator 10 has an open top top end 36, an open bottom end 38, a partially open back end wall (30) containing the opening (33), and a downwardly slanting floor 40 (FIG. 4) for the gravitational descent of epoxy material.

The bottom section 26 of front wall 16 has a pair of angle irons 42 and 44 attached thereto by means of nuts and bolts 46, 48. The slots 50 permit vertical adjustment of the applicator away from the floor 52, FIG. 4. A pair of skids 54 and 56 are secured to the horizontal legs 58 and 60 of the angle irons whereby the applicator 10 is easily and effortlessly moved along the floor 52 and wall 53 by pulling or pushing the applicator by handles 62 and 64 which handles may be positioned as in FIG. 1 or FIG. 4. A handle 65 is provided on the skids for ease in moving the applicator.

Figure 4:
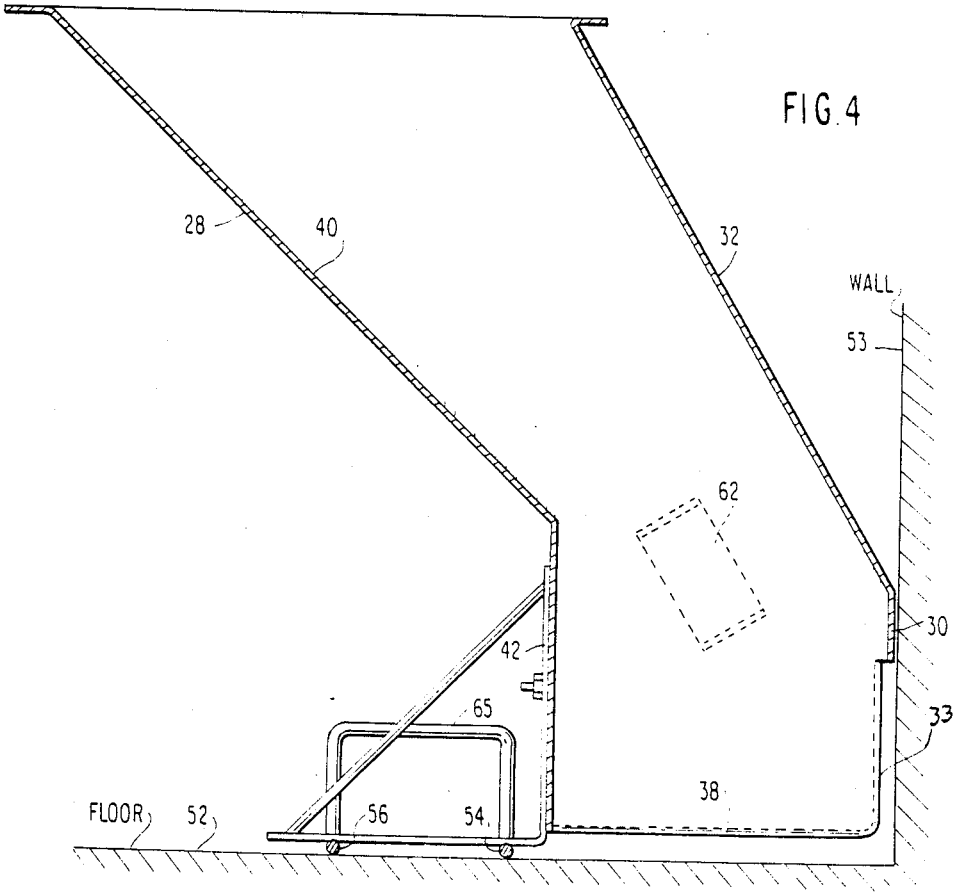
FIG. 4 is a side view in section of the applicator showing its position on the floor and against the wall where an epoxy mixture is to be applied.

In operation, the applicator is adjusted on the angle irons 42 and 44 to the desired elevation and the applicator is placed against the wall, FIG. 4, such that the short vertical wall section 30 abuts the wall 53 and the skids 54 and 56 rest on the floor 52. Epoxy material is poured into the top 36 of the applicator and said material flows downwardly on floor 40 into the bottom of the applicator and onto the floor 52 and against the wall 53. When the applicator is filled with epoxy material, it is moved along the floor and against the wall whereby a one-quarter inch thick layer of epoxy material is applied to the wall and a layer is applied to the floor. The thickness of the layer on the floor will be determined according to the vertical adjustment of the applicator on the angle irons. As the applicator is moved along the floor and against the wall, the epoxy material is trowelled onto the wall and against the floor by means of a hand held trowel resting on trowel wing 23 and against wing 27.

While the invention has been described with regard to a preferred embodiment thereof, it will be appreciated to those skilled in the art to which the invention pertains that numerous changes may be made in the invention without departing from the spirit and scope thereof.

What I claim is:

1. An epoxy applicator for simultaneously applying epoxy to a floor and to a contiguous lower portion of a wall which is substantially perpendicular to the floor, said applicator comprising:

a housing comprising a top end having a top opening for receiving epoxy, a bottom end having a bottom opening for spreading epoxy on the floor, and a back side having a back opening for simultaneously spreading epoxy on said lower portion of the wall, said bottom opening merging into said back opening at a bottom back edge of said housing, said housing also having a front side;

said back side having spacing means for keeping said back side spaced from the wall by a horizontal distance substantially equal to the thickness of the epoxy to be spread on said lower portion of said wall when said back side is resting against the wall; and supporting means, mounted on said front side of said housing, for resting on the floor, for supporting said housing so that said bottom end thereof is elevated from the floor by a vertical distance substantially equal to the thickness of the epoxy to be spread on the floor, and for facilitating sliding movement of said housing so that said bottom end of the housing moves parallel to the floor and so that said back side of said housing moves parallel to the wall while said spacing means rests against the wall;

wherein said spacing means comprises a vertical section of said back side, said section being located above said back opening and projecting rearwardly beyond the vertical plane of said back opening by a horizontal distance substantially equal to the thickness of the epoxy to be spread on said lower portion of wall;

wherein said supporting means comprises adjusting means for adjusting said vertical distance and, thereby, said thickness of the epoxy spread on the floor.

2. An epoxy applicator as defined in claim 1 wherein said supporting means comprises a pair of angle irons each having a vertical leg and a horizontal leg, said adjusting means being coupled between said front side of said housing and said vertical leg of each angle iron for adjusting the distance by which the horizontal angle iron legs project below said bottom end of said housing.

3. An epoxy applicator as defined in claim 2 wherein said supporting means comprises a pair of elongated parallel skid member means fixed to the bottoms of said horizontal legs of said angle irons, said skid member means being elongated in a direction which is parallel to both the floor and the wall.

4. An epoxy application as defined in claim 3 wherein said top end of said housing comprises a hopper which includes said top opening and which extends upwardly and forwardly from said bottom end of said housing, said hopper having a floor which slants downwardly and rearwardly for facilitating the gravitational flow of epoxy poured into said top opening.

5. An epoxy applicator as defined in claim 4 further comprising handle means mounted on said housing for permitting the pulling of said applicator along the floor and the wall.

6. An epoxy applicator as defined in claim 5 wherein said housing comprises trowel-supporting wing means, mounted adjacent said back and bottom openings and extending both vertically upwardly and horizontally forwardly, for supporting a hand-held trowel.

* * * * *